US005424501A

United States Patent [19]

Purves et al.

[11] Patent Number: 5,424,501

[45] Date of Patent: Jun. 13, 1995

[54] DECELERATION SENSOR SWITCH FOR USE IN A VEHICLE OCCUPANT SAFETY SYSTEM

[75] Inventors: James Purves, Pasadena; Saroj Manandhar, Chino Hills; Long T. Su, West Covina, all of Calif.

[73] Assignee: TRW Technar Inc., Irwindale, Calif.

[21] Appl. No.: 243,252

[22] Filed: May 16, 1994

[51] Int. Cl.[6] ..... H01H 35/14

[52] U.S. Cl. ..... 200/61.45 R; 200/61.48; 200/61.49; 200/61.51

[58] Field of Search ..... 200/61.45 R, 61.48–61.53, 200/61.45 M

[56] References Cited

U.S. PATENT DOCUMENTS

| | | | |
|---|---|---|---|
| 1,057,879 | 4/1913 | Quain | 200/61.49 |
| 2,076,251 | 4/1937 | Rockola | 200/61.51 |
| 2,263,471 | 11/1941 | Persons | 200/61.51 |
| 2,850,291 | 9/1958 | Ziccardi | 280/735 |
| 2,902,292 | 9/1959 | Land | 280/735 |
| 3,053,949 | 9/1962 | Johnson | 200/61.49 |
| 3,489,917 | 1/1970 | Gurol | 307/121 |
| 3,639,710 | 2/1972 | Haruna et al. | 200/61.48 |
| 3,731,022 | 5/1973 | Loftus | 200/61.49 |
| 3,762,494 | 10/1973 | Peters | 280/735 |
| 4,022,997 | 5/1977 | Inagaki et al. | 200/61.45 R |
| 4,104,493 | 8/1978 | Hibino et al. | 200/61.45 R |
| 4,249,046 | 2/1981 | Livers et al. | 200/61.45 R |
| 5,034,580 | 7/1991 | Tada et al. | 200/61.45 R |
| 5,306,883 | 4/1994 | Manandhar et al. | 200/61.53 |

*Primary Examiner*—J. R. Scott

*Attorney, Agent, or Firm*—Tarolli, Sundheim & Covell

[57] ABSTRACT

A deceleration sensor switch (10) comprises a base (12) and a mass (60) pivotable from an unactuated position to an actuated position when the mass is subjected to deceleration of at least a predetermined magnitude. A first electrically conductive portion (70) is connected to a first electrical terminal (46) mounted on the base (12). A support structure (40) supports the mass (60) on the base (12) to pivot from the unactuated position to the actuated position. The support structure (40) comprises a second electrical terminal (42) mounted on the base (12) and a second electrically conductive portion (50) interconnecting the second electrical terminal (42) and the mass (60). The second electrically conductive portion (50) comprises a spring portion (52) which deflects into electrical contact with the first electrically conductive portion (70) to electrically connect the first and second electrical terminals (46, 42) when the mass (60) pivots to the actuated position.

24 Claims, 2 Drawing Sheets

DECELERATION SENSOR SWITCH FOR USE IN A VEHICLE OCCUPANT SAFETY SYSTEM

BACKGROUND OF THE INVENTION

1. Technical Field

The present invention relates to a deceleration sensor switch, and is particularly directed to a deceleration sensor switch comprising a mass pivotable from an unactuated position to an actuated position in response to a predetermined deceleration.

2. Background Art

Deceleration sensor switches which include a mass pivotable from an unactuated position to an actuated position in response to a predetermined deceleration are known. Some known deceleration sensor switches include a mass which pivots from an unactuated position to an actuated position in response to a predetermined deceleration to move a contact into electrical contact with another contact. Some other known deceleration sensor switches include a mass which biases a contact away from another contact and which pivots from an unactuated position to an actuated position to allow the contacts to move into electrical contact with each other. Also, some of the known deceleration sensor switches have means for adjusting the responsiveness of the deceleration sensor switch.

SUMMARY OF THE INVENTION

In accordance with the present invention, a deceleration sensor switch comprises a base and a first electrical terminal mounted on the base. A first electrically conductive portion is connected to the first electrical terminal. The deceleration sensor switch further comprises a mass and support means for pivotably supporting the mass on the base such that the mass can pivot from an unactuated position to an actuated position when the mass is subjected to deceleration of at least a predetermined magnitude. The support means comprises a second electrical terminal mounted on the base and a second electrically conductive portion interconnecting the second electrical terminal and the mass. The second electrically conductive portion comprises a spring portion which deflects into electrical contact with the first electrically conductive portion to electrically connect the first and second electrical terminals when the mass pivots to the actuated position.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT

Figure 1:
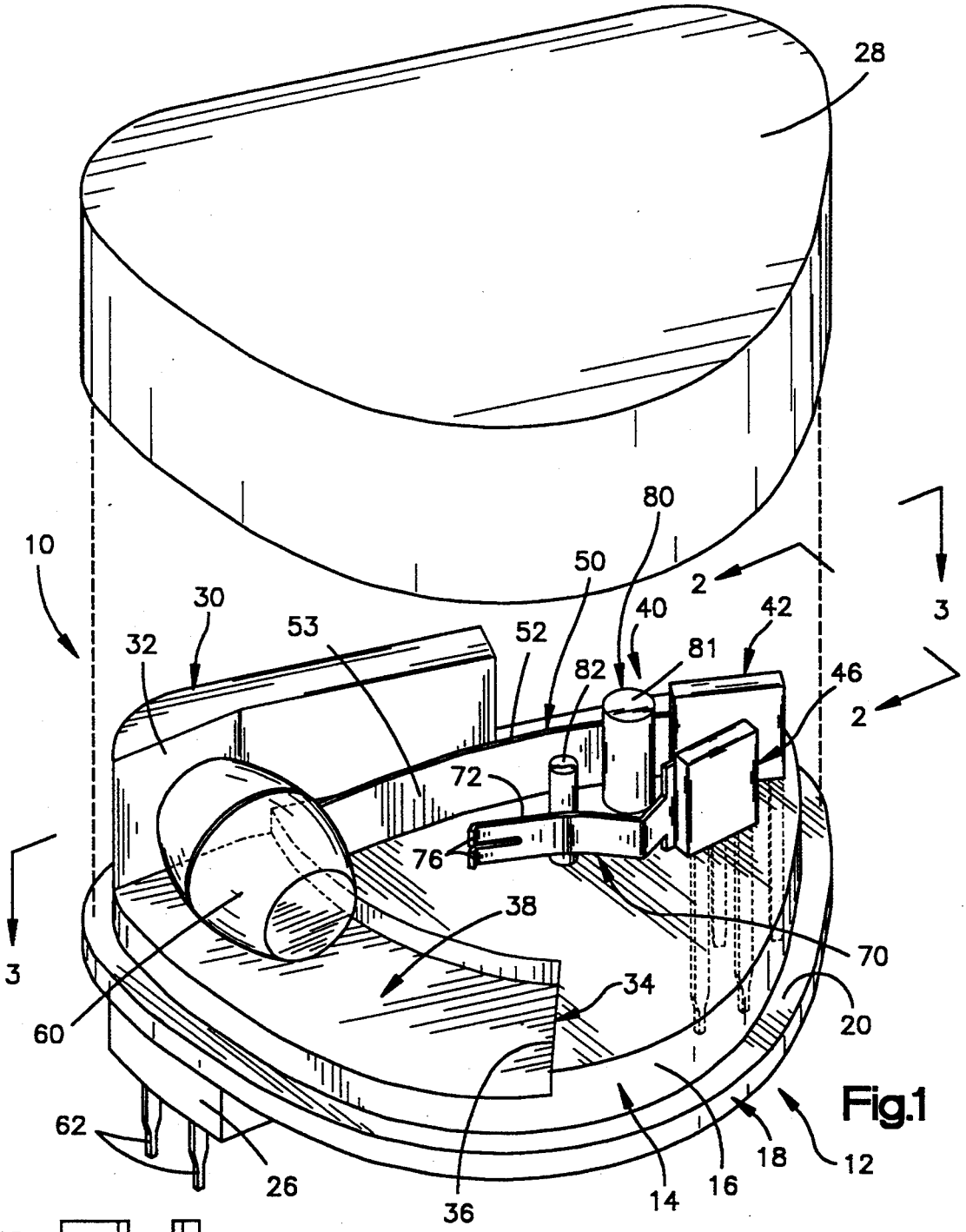
FIG. 1 is a perspective view of a deceleration sensor switch constructed in accordance with the present invention.

The present invention is directed to a deceleration sensor switch comprising a mass which pivots from an unactuated position to an actuated position in response to a predetermined acceleration. A deceleration sensor switch in accordance with the present invention may be used in a variety of different systems. The deceleration sensor switch is, however, particularly suited for use in a vehicle occupant safety system, such as an air bag system, to trigger inflation of an air bag in the event of vehicle deceleration indicative of a vehicle collision. A deceleration sensor switch 10 constructed in accordance with the present invention is shown in FIG. 1.

The deceleration sensor switch 10 includes a base 12. The base 12 has a flat, generally rectangular foundation plate 14 having a perimeter wall 16. A lip 18 runs circumferentially around the foot of the foundation plate 14 and projects from the perimeter wall 16 in a plane generally parallel to the plane of the foundation plate 14. A first terminal support part 24 (FIG. 2) is located adjacent one end of the foundation plate 14, and a second terminal support part 26 (FIG. 1) is located adjacent an opposite end of the foundation plate 14. The first and second terminal support parts 24, 26 project away from the bottom side of the foundation plate 14.

Figure 3:
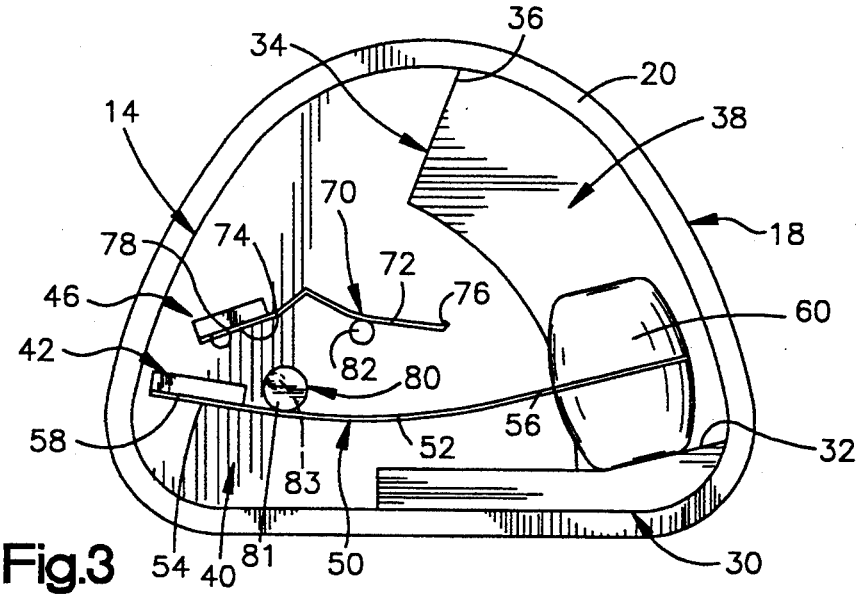
FIG. 3 is a plan view of the deceleration sensor switch of FIG. 1 as viewed in the direction along line 3—3 in FIG. 1.

As shown in FIGS. 1 and 3, the lip 18 establishes a ledge 20 of uniform width around the outer periphery of the base 12. The perimeter wall 16 of the foundation plate 14 extends perpendicular to the ledge 20. A cover 28 (shown only in FIG. 1) is sealingly engageable against the perimeter wall 16 of the foundation plate 14 and the ledge 20 to seal and protect the deceleration sensor switch 10.

A first stop portion 30 projects away from the foundation plate 14. Preferably, the base 12 and the first stop portion 30 comprise a single continuous piece of plastic molded material. The first stop portion 30 has a stopping surface 32. The base 12 defines a second stop portion 34 having a stopping surface 36 which faces toward the stopping surface 32 of the first stop portion 30. The base 12 defines an arcuate groove 38 which extends between the first and second stop portions 30, 34.

Figure 2:
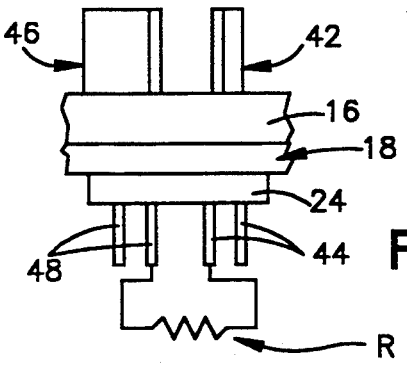
FIG. 2 is a fragmentary elevation view of a portion of FIG. 1, as viewed along line 2—2 in FIG. 1.

A terminal 46 made of a suitable electrical current conducting material, preferably stainless steel, is insert molded into the foundation plate 14 and the first terminal support part 24, as best shown in FIG. 2. The terminal 46 has bifurcated leg portions 48 which extend away from the first terminal support part 24. One of the leg portions 48 is connectable to a positive terminal of a voltage supply and the other one of the leg portions 48 is connectable to one end of an external resistor (R) for diagnostic purposes. The end of the terminal 46 opposite the leg portions 48 is one of a pair of electrical terminals of the deceleration sensor switch 10.

Figure 4:
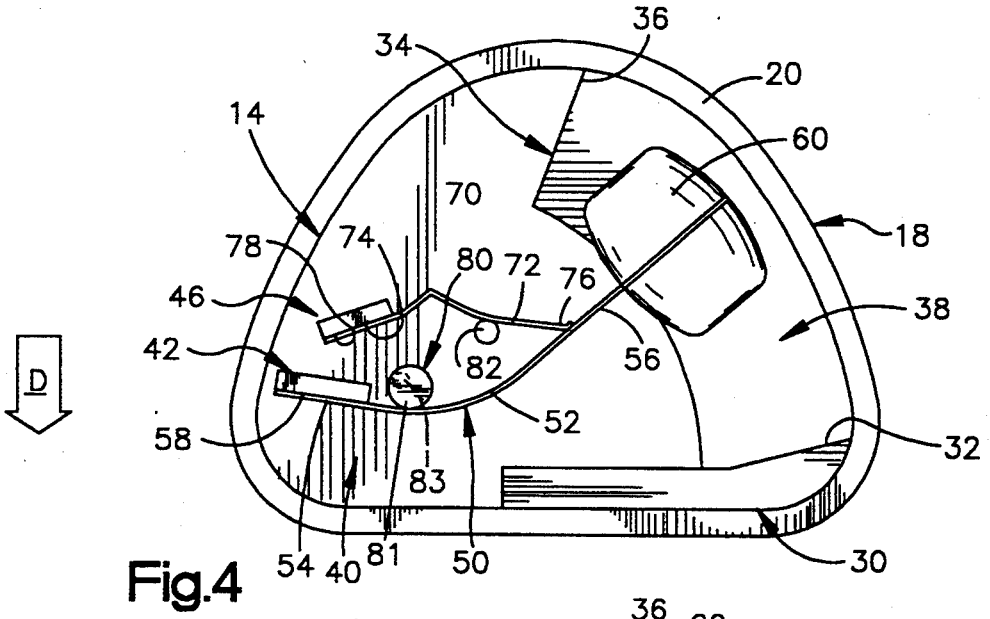
FIG. 4 is a plan view similar to FIG. 3 but showing parts of the deceleration sensor switch in other positions.
Figure 5:
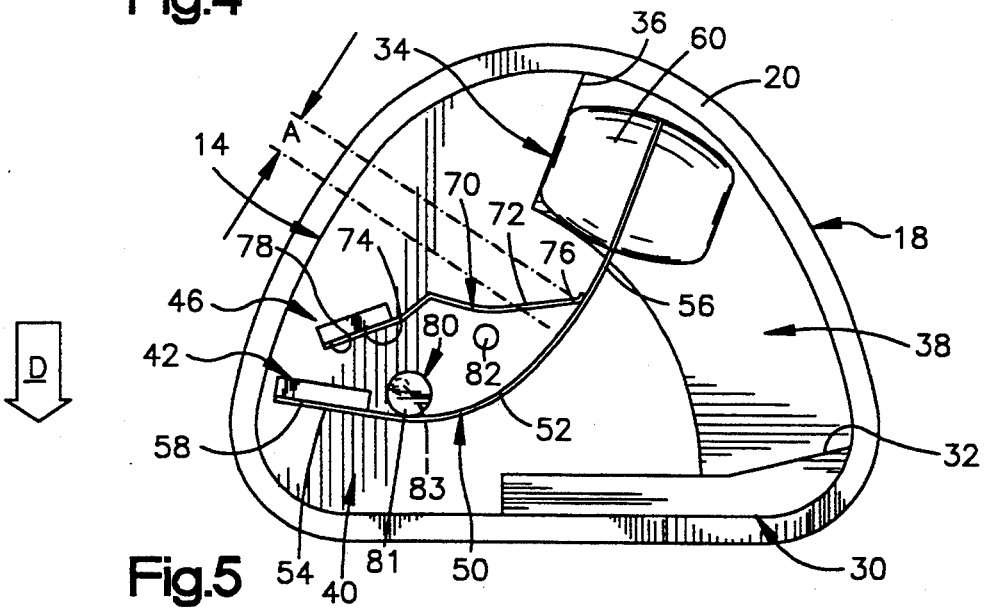
FIG. 5 is a plan view similar to FIG. 4 but showing parts of the deceleration sensor switch in still other positions.

A first contact 70 made of stainless steel has a contact portion 72 and an end portion 74 (see FIGS. 3–5). The end portion 74 is welded to a flat surface 78 of the terminal 46 so that the contact portion 72 of the first contact 70 extends horizontally, as viewed in FIG. 1. A metal pin 82 is insert molded in the foundation plate 14 and is located in the vicinity of the contact portion 72 of the first contact 70. The contact portion 72 has a spring-like resilience and rests against the metal pin 82 as shown in FIGS. 1 and 3. The contact portion 72 has a pair of spring-like fingers 76 (best shown in FIG. 1).

The deceleration sensor switch 10 further includes a support structure 40 disposed on the foundation plate 14 and spaced apart from the first and second stop portions 30, 34. The support structure 40 comprises a terminal 42 made of a suitable electrical current conducting material, preferably stainless steel. The terminal 42 is insert molded into the foundation plate 14 and the first terminal support part 24, as best shown in FIG. 2. The terminal 42 has bifurcated leg portions 44 which extend away from the first terminal support part 24. One of the leg portions 44 is connectable to a negative terminal of a voltage supply and the other one of the leg portions 44 is connectable to the other end of the external resistor (R) for diagnostic purposes. The end of the terminal 42 opposite the leg portions 44 is the other one of the pair of electrical terminals of the deceleration sensor switch 10. It will be noted that resistor (R) bridges the contacts of the deceleration sensor switch 10 and therefore provides a relatively high resistance current path across the switch 10 even when the switch 10 is in its normal, open position.

Another pair of leg portions 62 are insert molded into the second terminal support part 26. The leg portions 62 are electrically isolated from the switch terminals. Moreover, the leg portions 62 extend away from the second terminal support part 26 in the same direction as the leg portions 44 and 48 extend away from the first terminal support part 24. The three leg portions 44, 48, 62 support the deceleration sensor switch 10 when the switch 10 is mounted for use.

The support structure 40 further comprises a second contact 50 made of stainless steel. The second contact 50 is located adjacent the first contact 70. The second contact 50 includes a strip portion 52 having opposite end portions 54, 56 (see FIGS. 3–5). The end portion 54 is welded to a flat surface 58 of the terminal 42 so that the strip portion 52 of the second contact 50 extends horizontally, as viewed in FIG. 1. The strip portion 52, which is formed of a relatively thin, elongated, generally rectangular piece, acts as a leaf spring to provide a spring-like force to the second contact 50. The strip portion 52 of the second contact 50 is movable into electrical contact with the fingers 76 on the contact portion 72 of the first contact 70.

A barrel-shaped mass 60 is securely attached to the other end portion 56 of the second contact 50 and is movable with the end portion 56. The mass 60 may be securely attached to the end portion 56 of the second contact 50 in a number of ways. For example, as shown in FIG. 1, the mass 60 is constructed of two halves which are secured together with the end portion 56 clamped between the two halves of the mass 60 using a screw (not shown). The mass 60 is pivotable between an unactuated position shown in FIG. 3 and a fully actuated position shown in FIG. 5 along the arcuate groove 38 which extends between the first and second stop portions 30, 34.

An adjustable calibration member 80 in the form of a cam-shaped insert is located adjacent the strip portion 52 of the second contact 50. Specifically, the cam-shaped insert 80 includes a cylindrical body portion 81 and a pin portion 83 (shown in dotted line in FIGS. 3–5) which is attached on one end of the body portion 81. As shown in FIGS. 3–5, the pin portion 83 is positioned off center on the one end of the body portion 81. The pin portion 83 is snugly inserted into a hole in the foundation plate 14 to support the body portion 81 for turning about the longitudinal central axis of the pin portion 83 when the body portion 81 is manually turned. Since the pin portion 83 is positioned off center on the one end of the body portion 81, the position of the body portion 81 relative to the strip portion 52 is adjusted by manually turning the body portion 81 about the longitudinal central axis of the pin portion 83 to adjust the initial spring force exerted by the strip portion 52 of the second contact 50 on the mass 60.

When the fingers 76 of the contact portion 72 of the first contact 70 are not contacting the surface 53 on the strip portion 52 of the second contact 50, the second contact 50 and the first contact 70 are not electrically connected. The deceleration sensor switch 10 is then in a fully open condition, as shown in FIG. 3. When the deceleration sensor switch 10 is in the fully open condition shown in FIG. 3, the mass 60 abuts the stopping surface 32 of the first stop portion 30 so as to permit the fingers 76 of the first contact 70 to remain spaced apart from the surface 53 of the second contact 50.

When the deceleration sensor switch 10 is subjected to deceleration "D" of a predetermined magnitude, as would occur in a vehicle collision, the mass 60 pivots about the terminal 42 and moves along an arcuate path in the arcuate groove 38 which extends between the first and second stop portions 30, 34 against the resilient bias of the strip portion 52 of the second contact 50. As the mass 60 moves along the arcuate path in the arcuate groove 38, the mass 60 moves away from the stopping surface 32 of the first stopping portion 30. The mass 60 forces the strip portion 52 of the second contact 50 to flex towards the contact portion 72 of the first contact 70 (as viewed in FIGS. 3–5). As the mass 60 proceeds along its arcuate path in the arcuate groove 38, the strip portion 52 of the second contact 50 continues to move toward the contact portion 72 of the first contact 70 until the surface 53 of the second contact 50 moves into initial engagement with the fingers 76 of the first contact 70, as shown in FIG. 4. When the first and second contacts 70, 50 are in their initial engagement position shown in FIG. 4 and initial electrical contact is established between the terminal 42 and the terminal 46, the mass 60 is in an actuated position and the deceleration sensor switch 10 is in an initial closed condition.

Thereafter, as the mass 60 continues along its arcuate path in the arcuate groove 38 towards the second stop portion 34, the electrical contact established between the first and second contacts 70, 50 is maintained due to the spring-like resilience of the strip portion 52 and the contact portion 72. The mass 60 continues to move towards the second stop portion 34 until the mass 60 engages the stopping surface 36 of the second stop portion 34, as shown in FIG. 5. When the mass 60 engages the stopping surface 36, the mass 60 is in its fully actuated position and the first and second contacts 70, 50 are in a final engagement position. The deceleration sensor switch 10 is thus in a fully closed condition.

During the continued movement of the mass 60 towards the second stop portion 34, the fingers 76 of the first contact 70 wipe (slide) across the surface 53 of the second contact 50. The fingers 76 continue to wipe across the surface 53 until the first and second contacts 70, 50 reach their final engagement position, as shown in FIG. 5.

During the wiping movement of the first and second contacts 70, 50 from their initial engagement position shown in FIG. 4 to their final engagement position shown in FIG. 5, the fingers 76 of the contact portion 72 move a certain distance (designated with reference letter A in FIG. 5) across the surface 53 of the second contact 50. The distance A is relatively small, but is exaggerated in FIG. 5 for purposes of illustration. Electrical contact between the terminal 42 and the terminal 46 is maintained during the wiping movement.

By allowing the fingers 76 to wipe across the surface 53, the reliability of the electrical contact established between the terminal 42 and the terminal 46 is enhanced. The reliability enhancement arises because the wiping action helps to displace any small particles which may have come to rest between the surface 53 and the fingers 76. Also, the rubbing action which arises from the wiping motion helps to penetrate any oxides, corrosion, or other non-conducting film which may be present on the contact areas and thereby re-establish good electrical contact between the areas.

As the deceleration forces which caused the movement of the mass 60 to its fully actuated position dissipate, the resilience of the strip portion 52 causes the mass 60 to move from the fully actuated position shown in FIG. 5 back toward the unactuated position shown in FIG. 3. The mass 60 continues to move toward the unactuated position shown in FIG. 3 until the mass 60 returns to a resting position in engagement with the stopping surface 32 of the first stopping portion 30.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. A deceleration sensor switch comprising:

a base;

a first electrical terminal mounted on said base;

a first electrically conductive strip connected to said first electrical terminal;

a mass;

support means for pivotably supporting said mass on said base such that said mass can pivot from an unactuated position to an actuated position when said mass is subjected to deceleration of at least a predetermined magnitude, said support means comprising (i) a second electrical terminal mounted on said base and (ii) a second electrically conductive strip interconnecting said second electrical terminal and said mass to enable said mass and said second electrically conductive strip to pivot together about a fixed pivot point located at said second electrical terminal from said unactuated position to said actuated position, said mass being fixedly connected to an end of said second electrically conductive strip;

said second electrically conductive strip being located on only one side of said mass and comprising a spring portion which deflects into electrical contact with said first electrically conductive strip to electrically connect said first and second electrical terminals when said mass and said second electrically conductive strip pivot about said fixed pivot point to said actuated position.

2. A deceleration sensor switch according to claim 1 wherein said first electrically conductive strip comprises a spring portion against which said spring portion of said second electrically conductive strip engages to electrically connect said first and second electrical terminals when said mass and said second electrically conductive strip pivot about said fixed pivot point to said actuated position.

3. A deceleration sensor switch according to claim 1 wherein said base defines an arcuate groove in which said mass moves when said mass and said second electrically conductive strip pivot about said fixed pivot point to said actuated position.

4. A deceleration sensor switch according to claim 3 further comprising a first stop against which said mass is biased by said spring portion of said second electrically conductive strip when said mass is in said unactuated position, said first stop being located at one end of said arcuate groove.

5. A deceleration sensor switch according to claim 4 wherein said base defines a second stop located at an opposite end of said arcuate groove and against which said mass abuts when said mass is in a fully actuated position.

6. A deceleration sensor switch according to claim 4 wherein said base and said first stop comprise a single continuous piece of plastic molded material.

7. A deceleration sensor switch according to claim 1 further comprising means for adjusting the stiffness of said spring portion of said second electrically conductive strip.

8. A deceleration sensor switch according to claim 2 further comprising a first stop against which said mass is biased by said spring portion of said second electrically conductive strip when said mass is in said unactuated position.

9. A deceleration sensor switch according to claim 8 wherein said spring portion of said second electrically conductive strip is located between said first stop and said spring portion of said first electrically conductive strip.

10. A deceleration sensor switch according to claim 1 further comprising a cover engageable with said base to enclose said mass.

11. A deceleration sensor switch comprising:

a base including a planar surface area and means defining an arcuate groove adjacent said planar surface area;

a first electrical terminal mounted on said planar surface area;

a first electrically conductive portion connected to said first electrical terminal;

a mass located in part in said arcuate groove;

support means for pivotably supporting said mass on said planar surface area such that said mass can pivot along said arcuate groove from an unactuated position to an actuated position when said mass is subjected to deceleration of at least a predetermined magnitude, said support means comprising a second electrical terminal mounted on said planar surface area and a second electrically conductive portion interconnecting said second electrical terminal and said mass, at least parts of said second electrically conductive portion overlying part of said planar surface area and part of said arcuate groove, said second electrically conductive portion comprising a spring portion which deflects into electrical contact with said first electrically conductive portion to electrically connect said first and second electrical terminals when said mass pivots to said actuated position.

12. A deceleration sensor switch according to claim 11 wherein said first electrically conductive portion comprises a spring portion against which said spring portion of said second electrically conductive portion engages to electrically connect said first and second electrical terminals when said mass pivots to said actuated position.

13. A deceleration sensor switch according to claim 11 wherein said base defines a second stop located at an opposite end of said arcuate groove and against which said mass abuts when said mass is in a fully actuated position.

14. A deceleration sensor switch according to claim 11 wherein said base and said first stop comprise a single continuous piece of plastic molded material.

15. A deceleration sensor switch according to claim 11 further comprising means for adjusting the stiffness of said spring portion of said second electrically conductive portion.

16. A deceleration sensor switch according to claim 12 further comprising a first stop against which said mass is biased by said spring portion of said second electrically conductive portion when said mass is in said unactuated position.

17. A deceleration sensor switch according to claim 16 wherein said spring portion of said second electrically conductive portion is located between said first stop and said spring portion of said first electrically conductive portion.

18. A deceleration sensor switch according to claim 11 further comprising a cover engageable with said base to enclose said mass.

19. A deceleration sensor switch comprising:

a base;

a first electrical terminal mounted on said base;

a first electrically conductive portion connected to said first electrical terminal;

a mass;

support means for pivotably supporting said mass on said base such that said mass can pivot from an unactuated position to an actuated position when said mass is subjected to deceleration of at least a predetermined magnitude, said support means comprising a second electrical terminal mounted on said base and a second electrically conductive portion interconnecting said second electrical terminal and said mass, said second electrically conductive portion comprising a spring portion which deflects into electrical contact with said first electrically conductive portion to electrically connect said first and second electrical terminals when said mass pivots to said actuated position;

a first stop against which said mass is biased by said spring portion of said second electrically conductive portion when said mass is in said unactuated position; and a second stop against which said mass abuts when said mass is in a fully actuated position.

20. A deceleration sensor switch according to claim 19 wherein said first electrically conductive portion comprises a spring portion against which said spring portion of said second electrically conductive portion engages to electrically connect said first and second electrical terminals when said mass pivots to said actuated position.

21. A deceleration sensor switch according to claim 19 wherein said base and said first and second stops comprise a single continuous piece of plastic molded material.

22. A deceleration sensor switch according to claim 19 further comprising means for adjusting the stiffness of said spring portion of said second electrically conductive portion.

23. A deceleration sensor switch according to claim 20 wherein said spring portion of said second electrically conductive portion is located between said first stop and said spring portion of said first electrically conductive portion.

24. A deceleration sensor switch according to claim 19 further comprising a cover engageable with said base to enclose said mass.

* * * * *